United States Patent [19]

Van Oene

[11] Patent Number: 4,552,087

[45] Date of Patent: Nov. 12, 1985

[54] ANCHOR LIFTING DEVICE

[76] Inventor: Dale G. Van Oene, 305 - 165 W. 6th St., North Vancouver, British Columbia, Canada, V7M 1K4

[21] Appl. No.: 573,484

[22] Filed: Jan. 24, 1984

[51] Int. Cl.[4] ..... B63B 21/24

[52] U.S. Cl. ..... 114/297

[58] Field of Search ..... 441/3, 22, 23; 114/293, 114/297, 299, 311, 51; 254/405, 406

[56] References Cited

U.S. PATENT DOCUMENTS

| | | | |
|---|---|---|---|
| 875,387 | 12/1907 | Stam | 254/405 |
| 1,285,558 | 11/1918 | Campbell | 114/311 |
| 2,698,592 | 1/1955 | Landwehr | 114/311 |
| 3,094,095 | 6/1963 | Litchfield et al. | 114/297 |
| 3,472,195 | 10/1969 | Chiba | 114/311 |
| 3,913,514 | 10/1975 | Reynolds | 114/297 |
| 4,161,922 | 7/1979 | Fogg | 114/299 |

*Primary Examiner*—Trygve M. Blix
*Assistant Examiner*—Thomas J. Brahan
*Attorney, Agent, or Firm*—Christie, Parker & Hale

[57] ABSTRACT

An apparatus to allow hauling of a boat anchor, attached to an anchor line. The apparatus comprises a body that can be attached to a float and to a sea anchor. Once raised the anchor can be maintained in a raised position. There is a support for the line on the body. With release of the anchor from the bottom movement of the boat away from the anchor acts to haul in the line as the body tends to remain in one place under the influence of the sea anchor.

7 Claims, 9 Drawing Figures

ANCHOR LIFTING DEVICE

FIELD OF THE INVENTION

This invention relates to an anchor lifting apparatus.

Apparatus to assist in the hauling of an anchor, especially for small boats, are well-known in the patent literature but have not achieved commercial success. The hauling of an anchor in a small boat can be difficult and dangerous. This is particularly so where hauling by hand is carried out in rough seas. A boat may be fitted with a winch but even operation of the winch can be dangerous and, of course, a winch is a relatively expensive piece of equipment.

DESCRIPTION OF THE PRIOR ART

Fogg in U.S. Pat. No. 4,161,922 issued July 24, 1979 teaches an anchor caddy comprising a float attached to a pulley mechanism. The anchor line passes over a pulley and transmits horizontal pull forces about the vertical limb of the anchor. Fogg teaches dogging means in the form of a ratchet mechanism to secure the line during the pulling of the anchor but, at least compared with the present invention, the device in Fogg is a prelatively complicated device.

Sabella in U.S. Pat. No. 4,067,287 issued Jan. 10, 1978 shows a float and a tubular body that is opened and closed in a structure resembling the dogging device of Fogg. However the use of relatively intricate moving parts, such as ratchets and pawls and spring members on equipment to be used in sea water is not desirable.

Litchfield in U.S. Pat. No. 3,094,095 issued June 18, 1963 shows anchor hauling equipment that involves a float moving down a line to assist in the raising of the anchor.

Menard in U.S. Pat. No. 3,922,990 issued Dec. 2, 1975 shows an anchor raising device again relatively complicated and including releasable anchor line restraining means.

Reynolds in U.S. Pat. No. 3,913,514 teaches a float slidably attached to the anchor line and a submerged one way hook to prevent the anchor from sinking when the boat is no longer pulling on the anchor line.

Jonkman in U.S. Pat. No. 3,547,067 issued Dec. 15, 1970 shows a relatively massive structure featuring a sheave 8 positioned in a floating structure 6 and appears useful with relatively large vessels, for example ships and barges.

SUMMARY OF THE INVENTION

In contrast to the above the present invention is of extreme simplicity. In the preferred embodiment the only moving part is a roller but even that could be replaced, for example by a low friction fixed member.

Accordingly, the present invention provides, in one aspect, an apparatus to allow hauling of a boat anchor, attached to a line, the apparatus comprising: a body; means to attach the body to a float; means to attach the body to a sea anchor; a support for the line on the body, whereby release of the anchor from the bottom raises the anchor on the float, movement of the boat away from the anchor when acting to haul in the line as the body tends to remain in one place under the influence of the sea anchor.

In a further aspect the present invention is an apparatus to allow hauling of a boat anchor attached to a line the apparatus comprising; a first, elongate limb; a sea anchor attached to the first limb; a float attached to the first limb; a second and third limb formed on the first limb; a support for the line located between the second and third limbs to form a recess to maintain the line whereby release of the anchor from the bottom raises the anchor on the float, moving the boat away from the anchor then acting to haul in the line as the body tends to remain in one place under the influence of the sea anchor.

DRAWINGS

Aspects of the invention are illustrated, merely by way of example, in the accompanying drawings in which:

FIG. 1*a* illustrates a boat at anchor with apparatus according to the present invention attached to the anchor line;

FIG. 1*b* shows the anchor raised;

FIG. 2*a* shows a boat at anchor using a variation of the FIG. 1*a* apparatus;

FIG. 2*b* shows the anchor raised;

DESCRIPTION OF THE PREFERRED EMBODIMENT

Figure 1A:
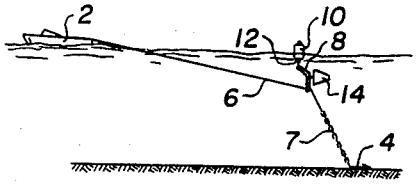

In the drawings FIG. 1 shows a boat 2 secured by anchor 4 attached to line 6. The line 6 includes a chain length 7. Also attached to the anchor line is apparatus according to the present invention comprising an elongate limb 8, of generally L-shape, having a float 10 attached at one end by the use of a releasable clip 12 and having a sea anchor 14 attached to its middle. The sea anchor 14 may comprise a simple bag whose mouth 16 is located by a metal circle 18 to which a bracket 20 is attached. Clip 22 then secures the bracket to the limb 8.

Figure 5:
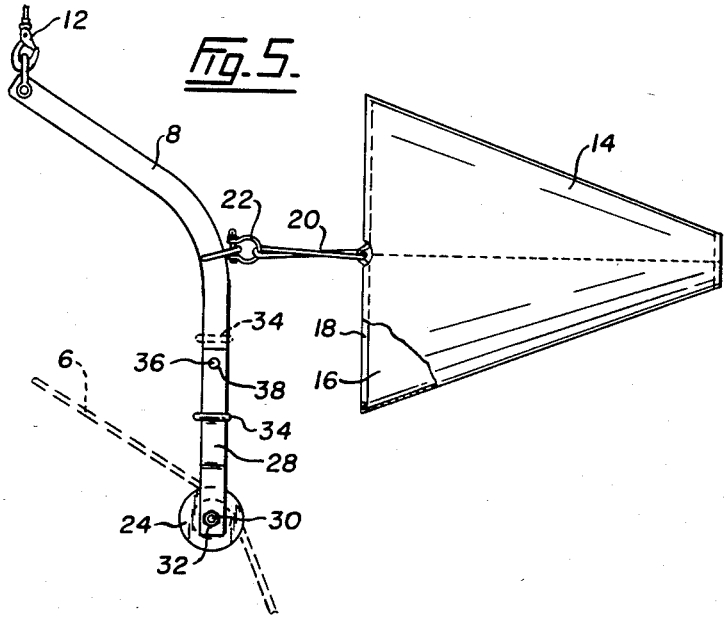
FIG. 5 is a partial view of the apparatus according to the present invention.
Figure 6:
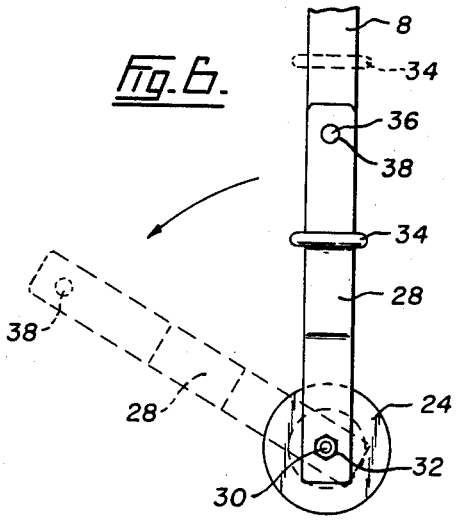
FIGS. 6 and 7 are details of the apparatus according to the present invention.

The anchor line 6 passes over a roller 24 located between branches 26 and 28 of the limb 8. A bolt 30 whose head is welded to limb 26 rotatably carries the roller 24. A nut 32 is welded to the other limb 28 to engage the bolt 30. There is a sleeve 34 acting to locate the two limbs 26 and 28 together but movable to release the limbs—see the broken line position for sleeve 34 in FIGS. 5 and 6. The use of nut 32 welded to limb 28 allows the limb 28 to rotate relative to limb 26. For additional security a peg 36 is formed on limb 26 to engage in a recess 38 formed in limb 28.

The arrangement ensures that a recess 40 is formed between the limbs 26 and 28, above roller 24.

Figure 1B:
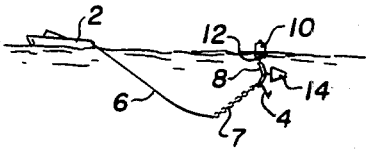
Figure 2A:
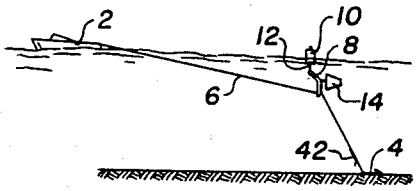
Figure 7:
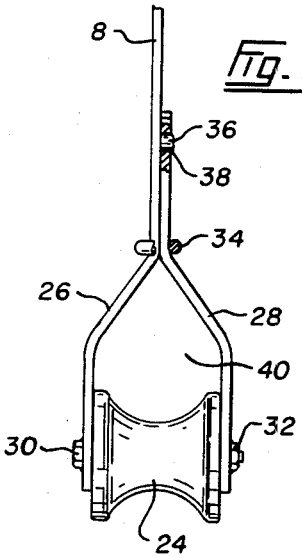

In the drawings FIGS. 1*a* and 2*a* show the boat at anchor with the apparatus attached. However because of the nature of the present invention the apparatus need not be attached to the anchor line 6 until it is required to haul the anchor. At that stage sleeve 34 can be moved upwardly and the limb 28 disengaged in the peg 36 and rotated—see FIG. 6. The apparatus is then positioned over the anchor line 6, the limb 28 is moved back to the FIG. 7 position and sleeve 34 is pushed over the limbs. Anchor line 6 is in recess 40, over roller 24. The embodiment of FIGS. 1*a* and 1*b* show the chain 7 as part of the anchor line 6 whereas the embodiment of FIGS. 2*a*, 2*b*, 3 and 4 shows the use of a hook member 42 attached by clips 44 to the rope 6. Generally speaking boats in fresh water, especially light boats, may use a rope but a boat to be used in salt water may use a rope but a length of chain, normally about the length of the boat. The invention operates in the same way but the embodiments of FIGS. 1*a* and 1*b* and 2*a* and 2*b* differ from each other simply in the way in which the anchor is prevented from sliding back once it has been hauled up to the apparatus according to the present invention.

Thus the apparatus functions as follows. The boat 2 is manoeuvered to release the anchor 4. To do this the boat 2 may be manoeuvered forward until it moves the anchor from its holding position on the sea bed. At that stage the boat 2 may be reversed away from the apparatus. The anchor 4 is maintained off the sea bed by float 10 and, of course by tension in the anchor line 6. The sea anchor 14 tends to resist movement and this allows the boat 2 to move away from limb 8 so that the anchor 4 is raised until it contacts the limbs 26 and 28 where it cannot pass through recess 40.

Figure 2B:
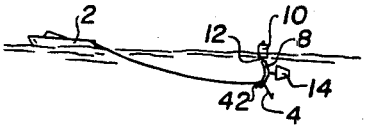
Figure 3:
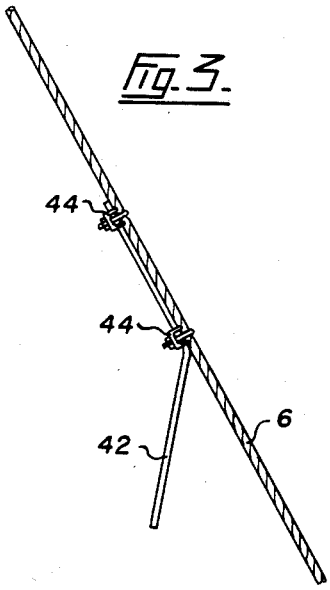
FIGS. 3 and 4 show the use of a hook with apparatus according to the invention.
Figure 4:
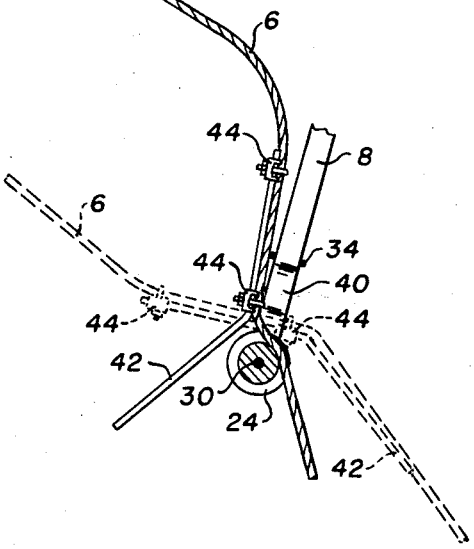

In the embodiment of FIGS. 1*a* and 1*b* the weight of the length of chain 7 is such that the chain acts as a counter balance to the anchor, that is in the position shown in FIG. 1*b* the anchor cannot slide back to the bottom because the chain 7 is on the other side of the roller to the anchor and thus acts as an effective counter weight, being heavier than the anchor, to prevent movement of the anchor downwardly. In the embodiments of FIGS. 2*a* and 2*b*, as shown particularly in FIG. 4 although the hook 42 may pass through the recess 40 when the anchor tends to move downwardly, that is back towards the sea bed, the hook engages the roller 24, as shown in solid lines in FIG. 4, and prevents movement of the anchor.

In both embodiments the line 6, with the apparatus attached, may be simply hauled in by hand, if necessary from a sitting position in the boat 2. Alternatively the boat 2 can be moved towards the anchor 4 and the line 6 gathered in as the boat proceeds. The apparatus is then hauled into the boat and may be stored. It should be noted that the anchor will, of course, remain on the surface so that the boat may simply be allowed to drift back towards the anchor with the anchor line being gathered in by hand.

It should be noted that because of its simplicity the sea anchor 14 can easily fold away to occupy negligible space. The float 10 is desirably an inflatable bumper as such equipment is normally present on a boat to prevent damage to the boat on docking.

The present invention is desirably of stainless steel to resist corrosion but, of course, may be made any material of appropriate strength.

Although a roller 24 is illustrated, as indicated above the roller may be replaced by a simple non-rotating member, preferably of a low friction plastics material.

A bolt 30 is shown as a means of attaching the roller 24 but a simple shaft of any type will suffice, for example retained by cotter pins or the like at its ends.

The apparatus according to the present invention is extremely simple to operate and entirely safe. It can be operated entirely by the power of a boat, that is the sailor need not enter the bow of the boat but can release the anchor simply by manoeuvering the boat.

I claim:

1. Apparatus to allow hauling of a boat anchor attached to an anchor line the apparatus comprising;

a first, elongate limb of general L-shape having an arcuate middle portion;

a sea anchor attached to the first limb generally adjacent said arcuate middle portion;

a float attached to the first limb at one end;

first and second branches formed on the first limb at the other end;

means attached to said anchor line to maintain the anchor in a raised position;

a support for the anchor line located between the first and second branches to form a recess to maintain the anchor line, one of the first and second branches adapted to move relative to the other to allow opening of the recess for introduction of the anchor line and means to retain the recess closed whereby with release of the anchor from the bottom moving the boat away from the anchor acts to haul in the anchor line as the elongate limb tends to remain in one place under the influence of the sea anchor.

2. Apparatus as claimed in claim 1 in which the support is a roller.

3. Apparatus as claimed in claim 1 in which the means to retain the recess closed comprises a sleeve fitting over both the first and second branches.

4. Apparatus as claimed in claim 3 including a peg formed on one of the first and second branches to extend to engage a recess formed on the other of the first and second branches.

5. Apparatus as claimed in claim 1 in which the means to maintain the anchor in a raised position is a chain forming at least part of the anchor line, the chain acting as a counter balance for the anchor whereby when the chain is hauled over the support and through the recess it prevents the anchor from sinking back towards the bottom.

6. Apparatus as claimed in claim 1 in which the means to maintain the anchor in a raised position is a rigid hook attached to the anchor line whereby when the hook is hauled through the recess it cannot pass back through the recess and thus prevents the anchor sinking back to the bottom.

7. An apparatus for hauling in an achor deployed from a boat, the apparatus comprising:

an anchor line extending from the boat to the anchor, the line including a leader portion adjacent to the anchor and extending for a length sufficient that the leader portion weighs at least as much as the anchor;

an L-shaped limb having at one end first and second branches mounting an upper line support therebetween, one of said branches disconnectable from the other for attaching the limb to the deployed line;

a float attached to the other end of the limb to retain the limb adjacent the water surface;

a sea anchor deployed from the limb medially thereof to resist movement by the limb, hauling the line and leader over the support raising the anchor to a position proximate the branches, the leader acting as a counterweight to prevent dropping of the raised anchor.

* * * * *

UNITED STATES PATENT AND TRADEMARK OFFICE

CERTIFICATE OF CORRECTION

PATENT NO. : 4,552,087

DATED : 12 NOVEMBER 1985

INVENTOR(S) : DALE G. VAN OENE

It is certified that error appears in the above-identified patent and that said Letters Patent is hereby corrected as shown below:

Column 1, line 24, "prerelatively" should be -- relatively --.

Column 1, line 62, "when" should be -- then --.

Column 3, lines 1,2, after "use" delete the words "a rope but" --.

Column 3, lines 9, 10, "manoeuvered" should be -- maneuvered --.

Column 3, lines 11,13, "sea bed" should be -- seabed --.

Column 3, line 22, "counter balance" should be -- counterbalance --.

Column 3, line 25, "counter weight" should be -- counterweight --.

Column 3, line 31, "sea bed" should be -- seabed --.

UNITED STATES PATENT AND TRADEMARK OFFICE

CERTIFICATE OF CORRECTION

PATENT NO. : 4,552,087

DATED : 12 NOVEMBER 1985

INVENTOR(S) : DALE G. VAN OENE

It is certified that error appears in the above-identified patent and that said Letters Patent is hereby corrected as shown below:

Column 3, line 51, after "made" insert -- of --.

Column 3, line 64, "manoeuvering" should be -- maneuvering --.

Column 4, line 35, "counter balance" should be counterbalance --.

Column 4, line 45, "achor" should be -- anchor --.

Column 4, line 53, "upper" should be -- anchor --.

Signed and Sealed this

*Eighth* Day of *April 1986*

[SEAL]

*Attest:*

DONALD J. QUIGG

*Attesting Officer*

*Commissioner of Patents and Trademarks*